US005425449A

United States Patent [19]

Boorady

[11] Patent Number: 5,425,449

[45] Date of Patent: Jun. 20, 1995

[54] CONVERTIBLE BAG AND A METHOD FOR CONVERTING THE BAG BETWEEN TWO FUNCTIONAL CARRYING MODES

[76] Inventor: Charles A. Boorady, 2600 N. Hampden Ct., 2F, Chicago, Ill. 60614

[21] Appl. No.: 103,793

[22] Filed: Aug. 10, 1993

[51] Int. Cl.[6] ..... A45C 5/12; A45C 7/00; A45C 13/10; A45C 13/30

[52] U.S. Cl. ..... 206/287.1; 206/279; 206/298; 190/1; 190/107; 190/36; 190/903; 383/4

[58] Field of Search ..... 190/36, 1, 107, 109, 190/903, 103; 383/4, 2; 206/279, 287.1, 278, 287, 292, 293, 298; D3/278

[56] References Cited

U.S. PATENT DOCUMENTS

| | | | |
|---|---|---|---|
| D. 279,144 | 6/1985 | Allen | D3/278 |
| D. 282,315 | 1/1986 | Allen | D3/278 |
| 1,913,021 | 6/1933 | Butterick | D3/278 X |
| 1,914,087 | 6/1933 | Gilmore | 190/107 X |
| 1,919,082 | 7/1933 | Wheary | 190/36 |
| 1,975,294 | 10/1934 | Sand et al. | 190/107 X |
| 2,893,523 | 7/1959 | Mitchell | 206/298 |
| 3,042,939 | 7/1962 | Schoellkopf, Jr. et al. | 383/4 X |
| 3,830,348 | 8/1974 | Ohyama | 190/107 |
| 4,090,593 | 5/1978 | Koff | 190/111 X |
| 4,170,282 | 10/1979 | Schwartzstein | 206/287.1 |

FOREIGN PATENT DOCUMENTS

| | | | |
|---|---|---|---|
| 5130910 | 5/1993 | Japan | 203/282.1 |

*Primary Examiner*—Sue A. Weaver
*Attorney, Agent, or Firm*—Hill, Steadman & Simpson

[57] ABSTRACT

A carrier is provided for converting from a duffle-type bag to a folding, garment bag and vice versa. The duffle-type bag includes an oblong, soft-sided, expansible central compartment having an access through the top thereof. The garment bag includes a cover portion having a closure for receiving into a central compartment one or more garments such as suits, dresses, and the like. At least one hook may be provided for receiving a hanger holding the garments. The bag may be readily converted by a user from the duffle-type bag to the garment bag for the particular mode of transport and uses desired.

15 Claims, 2 Drawing Sheets

CONVERTIBLE BAG AND A METHOD FOR CONVERTING THE BAG BETWEEN TWO FUNCTIONAL CARRYING MODES

BACKGROUND OF THE INVENTION

The present invention generally relates to a bag for independently carrying different types of articles. More specifically, the invention relates to a duffle-type bag which can be converted to a garment-type bag wherein the duffle-type bag carries athletic gear and the like, and the garment bag carries hanging articles, such as a suit, a dress, or the like.

Duffle bags are commonly used for transporting athletic gear and similar type clothing by patrons of health clubs, racket clubs, country clubs and other such activity centers. Typically, such patrons wear professional clothing to activity centers, and the patrons require changing into athletic gear at the center. After working out, for example, at the activity center, the patron may require changing back into the professional clothing to return to work or the like. In the alternative, the athletic gear may be continued to be worn by the patron, and the professional clothing may require hanging for carrying of the clothing to a second destination without wrinkling or otherwise damaging the clothing.

To this end, patrons of health clubs, for example, often carry both a duffle bag and a garment bag. The duffle bag includes the athletic gear required for working out, and the garment bag carries the suit, the dress, or the like worn by the individual. If the individual works out prior to going to his job, a suit or uniform remains neat during transport for wearing the same for the remainder of the day or any portion of the day.

As a result of the foregoing scenarios, these patrons are burdened by carrying a duffle bag for athletic clothes and a garment bag for professional clothes. Further, the undesirability of carrying two bags is magnified for patrons who require the use of public transportation, such as in congested cities. Often, additional bags may also be required, such as suitcases for traveling or brief cases for carrying work or other necessities. Still further, carrying multiple bags is often undesirable for certain individuals since additional bags may create vulnerability of the individual to robbers or pick-pocketers. In addition, many individuals would prefer carrying an indiscreet number of bags to maintain a professional image.

To minimize the number of bags carried to, for example, activity centers, individuals often carry folded garment bags inside of a duffle bag. This reduces the number of bags actually carried to the activity center. However, both bags must be carried home from the activity center by the patron since a full garment bag will not generally stow within a duffle bag.

In the alterative, a single garment bag may be used to transport athletic gear and clothing to the center. Therefore, a duffle bag need not be carried by the individual. However, many individuals prefer carrying their athletic gear and other required clothing to work before travelling to the particular activity center since a smaller, more discreet duffle-type bag is generally more desirable for carrying into the individual's work place.

A need, therefore, exists for an improved convertible bag for carrying both professional clothes and carrying athletic wear independently from one another.

SUMMARY OF THE INVENTION

The present invention provides a bag convertible between a garment bag and a duffle-type bag. The convertible bag provides a compartment for carrying athletic gear and the like in a duffle bag mode and a compartment for carrying professional clothing, such as suits, dresses and the like, in a garment bag mode. The duffle bag mode and the garment bag mode are independent modes and cannot be implemented concurrently.

To this end, the present invention provides a convertible bag for holding a first set of articles in a first mode and a second set of articles in a second mode. The bag comprises a first compartment having an interior substantially defined by a top wall, a bottom wall, two side walls, a back wall and a front wall wherein the interior is accessed by inverting the front wall and further wherein the interior includes a means for supporting at least one hanging article of the first set of articles therein in the first mode. A first closure secures the front wall thereby enclosing the first set of articles in the interior in the first mode wherein an exterior shell for the interior of the compartment is formed by securing of the closure. A second closure on an outside wall of the exterior shell is provided wherein the second closure, when secured, forms a second compartment for holding the second set of articles in the second mode independent of the first articles in the first mode.

In an embodiment, the bag of the present invention further provides a restraining bar in the interior of the first compartment for maintaining position of at least one article of the first set in the first mode. In an embodiment, the restraining bar is collapsible enabling use of the second compartment. In another embodiment, the restraining bar is removable to enable use of the second compartment.

In an embodiment, the bag of the present invention provides a strap for assisting in carrying the bag during use in the first mode.

In an embodiment, the first closure is a slide fastener having a plurality of teeth of a first size and the second closure is a slide fastener having a plurality of teeth of a second size.

In an embodiment, the bag of the present invention further provides at least one handle for holding the bag in the second mode.

The present invention further provides a bag convertible between a duffle bag for carrying a first set of articles. The bag comprises a first closure, a front wall and a back wall substantially secured together by the first closure forming a first compartment having a first interior for holding the first set of articles. A second closure is arranged on the back wall encompassing an area of the back wall wherein the area is a portion of the back wall and further wherein the area is divisible at a fold line dividing the area into two substantially equivalent areas. A second compartment is formed by securing the second closure forming a second interior for holding the second set of articles wherein the first compartment is usable only when the second compartment is not in use.

In an embodiment, the bag of the present invention further provides at least one exterior compartment for holding additional articles outside of the interior of the first compartment.

In an embodiment, the bag of the present invention further provides an exterior hanging device for suspending the garment bag to assist in accessing of the interior.

The present invention further provides a method for converting a garment bag to a duffle bag having at least one interior compartment. The method comprises the step of providing the garment bag having a first side and a second side secured by a first closure forming the at least one interior compartment wherein the second side includes a midpoint and a first side includes a second closure; placing the garment bag on the first side such that the second side faces up; folding a portion of each end of the garment bag toward the midpoint of the second side; folding the garment bag at the midpoint of the second side; and securing the closure on the first side wherein the second side forms an interior wall of the interior compartment and at least a portion of the first side forms an exterior wall of the interior compartment.

In an embodiment, the method further comprises the step of providing a strap for holding the garment bag by a user.

In an embodiment, the method further comprises the step of providing at least one handle for holding the duffle bag by a user.

It is, therefore, an object of the present invention to provide a device which is easily convertible from a duffle-type bag to a garment-type bag and vice versa.

Another advantage of the present invention is to provide a carrier wherein, in a garment-type bag mode, the carrier can carry a variety of clothing including but not limited to a man's suit, a woman's suit, a dress, a mechanic's uniform, a doctor's uniform, and other professional and non-professional clothing.

Yet another advantage of the present invention is to provide a product which, while in a garment-type bag mode, carries a variety of items in separate compartments.

Further, an advantage of the present invention is to provide a product which, while in a duffle-type bag mode, carries a variety of items including, but not limited to, items which are generally used at health clubs, racket clubs, and other activity centers, e.g. athletic clothing and foot wear, cosmetics, towels, casual clothing, portable radios, and the like.

Moreover, an advantage of the present invention is to provide a product which protects contents against damage from exterior elements and which separates items which might soil or damage each other, e.g. maintaining a suit separate from wet towels, for example, and athletic gear.

And, another advantage of the present invention is to provide a product which is easy to carry in a duffle-type bag mode as well as in a garment-type bag mode.

Still further, an advantage of the present invention is to provide a product whose design and production minimizes damage to the environment.

Yet another advantage of the present invention is to provide a product which is easy to pack and unpack with gear, clothing and other like items.

Another advantage of the present invention is to provide a bag which is durable including strong fastening devices.

Further, an advantage of the present invention is to provide a product which is convenient for use.

Moreover, an advantage of the present invention is to provide a product which is weather-proof.

A still further advantage of the present invention is to provide a product which minimizes the likelihood of theft or robbery of the product, its components, and its contents.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
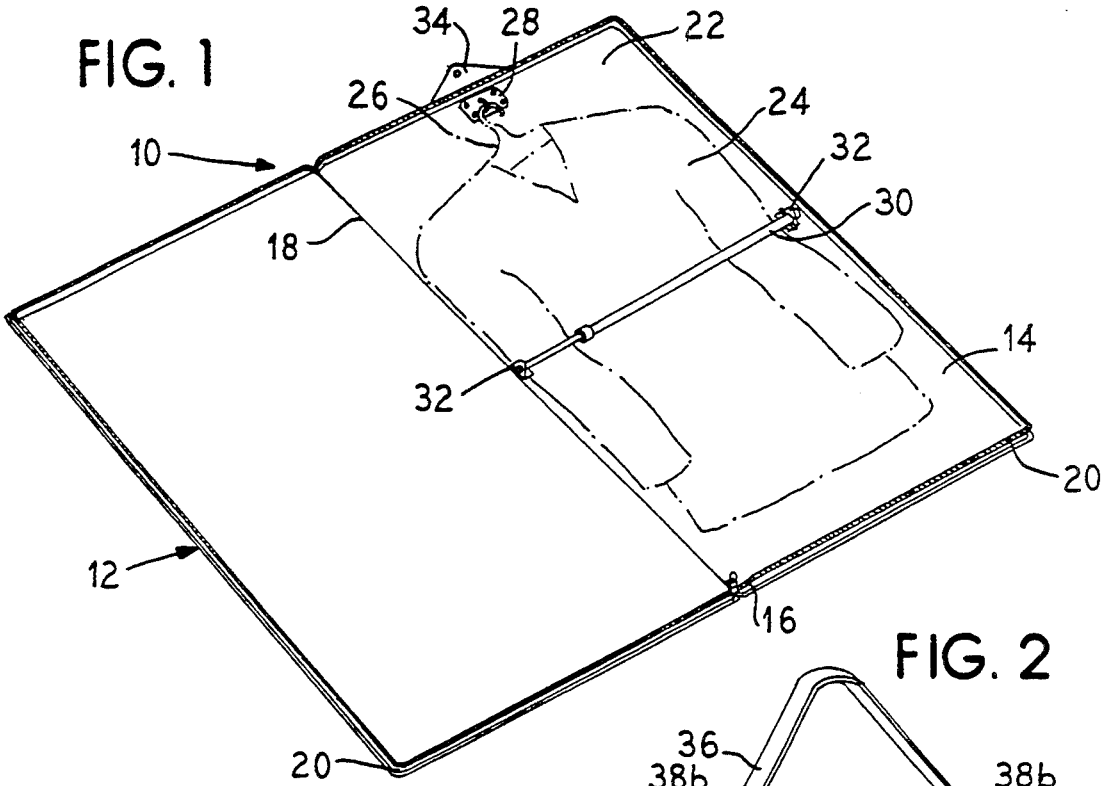
FIG. 1 illustrates a perspective view of the convertible bag of the present invention in a garment bag mode.

A carrying piece is provided for converting between a garment bag and a duffle bag. The garment bag is particularly useful for carrying hanging-type clothes, such as suits, dresses and the like. The duffle-type bag is particularly useful for carrying articles such as athletic wear, shoes, cosmetics, portable radios, and the like.

Referring now to the drawings, wherein like numerals designate like parts, a carrier 10 is generally shown. The carrier 10 includes a top wall 12, a back wall 14 and a slide fastener 16 secured about the periphery of the top wall 12 and the back wall 14 except at the common junction or fold 18 therebetween. A side wall 20 is further formed in the area between the peripheral slide fastener 16 and the top wall 12 and the peripheral slide fastener 16 and the back wall 14, respectively. The side wall 20 provides depth for articles to be placed in an interior 22 of the carrier 10. The side wall 20 may be dimensioned as desired for varying the capacity of the carrier 10.

As illustrated in FIG. 1, an article 24 supported on a hanger 26 is shown. The article 24 is generally a garment, such as a suit, blouse, dress shirt, dress, uniform or any combination of same which is typically worn, for example, at a work place of an individual. The hanger 26 is suspended from a hanging device 28 as shown. The hanging device 28, of course, may be any sort of hanging device for suspending a hanger or hangers therefrom. The hanging device 28 as illustrated is riveted to the interior 22 on the back wall 14 of the carrier 10.

Alternatively, the hanging device 28 may be secured by a known means to, for example, the side wall 20.

A rigid bar 30, typically made of a metal, such as steel, or a rigid plastic, is shown at substantially a midpoint of the back wall 14 of the carrier 10. The rigid bar 30 is removably secured at its ends by the attachment mechanisms 32. The rigid bar 30 is collapsible, foldable or otherwise removable from the carrier 10 to convert from the garment bag illustrated in FIG. 1 to a duffle-type bag later described. The bar 30, however, provides rigidity when the garment bag is being carried by an individual, such as in the position illustrated in FIG. 2.

The carrier 10 may further include an exterior suspending device 34. The suspending device 34 may be suspended over, for example, a hook on a door or wall, for assisting in enabling loading and/or unloading of the articles 24 from the interior 22 of the carrier 10.

Figure 2:
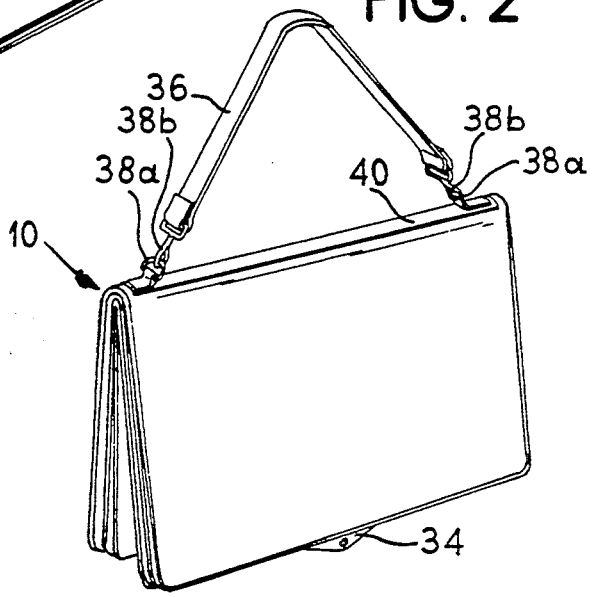
FIG. 2 illustrates a perspective view of the convertible bag of the present invention in a closed or carrying position of the garment bag mode.

Referring now to FIG. 2, the carrier 10 includes a shoulder strap 36 for an individual to support the carrier 10 over his shoulder. The shoulder strap 36 is adjustable in length and may be removably attached to the carrier 10 by, for example, a combination of universal fastening devices 38*a*, 38*b*. The exterior of the carrier 10 may be reinforced at an exterior point generally shown at 40 opposite the rigid bar 30 within the interior of the carrier 10.

Figure 3:
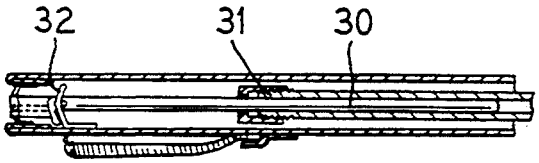
FIG. 3 illustrates a partial cross-sectional view of the convertible bag of the present invention.

As shown in FIG. 3, the rigid bar 30 is removably secured at the attachment mechanism 32. A clamping device 31 is provided intermediate the ends of the bar 30 for telescopically adjusting the length of the bar 30. This particular configuration enables removal of the bar 30 from the attachment mechanisms 32 (at both ends) and further collapsing of the bar 30 to enable conversion to the duffle-type bag without interference of the bar 30. The attachment mechanisms 32 may be secured to the side walls of the carrier 10 in a conventional manner, such as by riveting.

Figure 4:
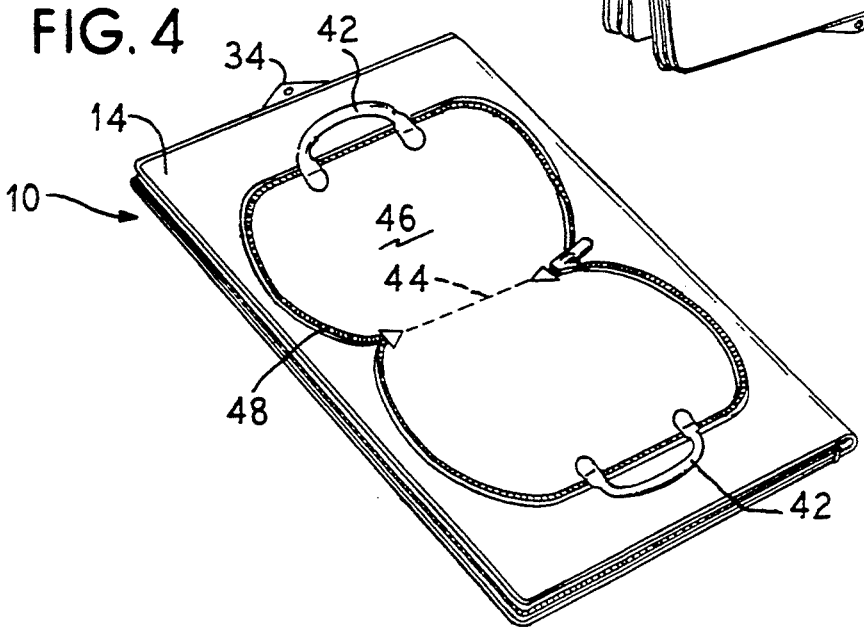
FIG. 4 illustrates a perspective view of a back side of the convertible bag of the present invention.

Referring now to FIG. 4, the exterior side of the back wall 14 of the carrier 10 is shown. The exterior side of the back wall 14 includes the components required for converting the garment bag into the duffle-type bag. To this end, two handles 42 are provided substantially equidistant from a center line 44 of the carrier 10. The handles 42 are further secured to an exterior wall 46 which makes up a portion of the exterior side of the back wall 14. The exterior wall 46 includes two halves which are mirror images of each other along the center line 44. About the periphery of the exterior wall 46 is a slide fastener 48 which forms the duffle-type bag as will be described with reference to FIGS. 5–9.

Figure 5:
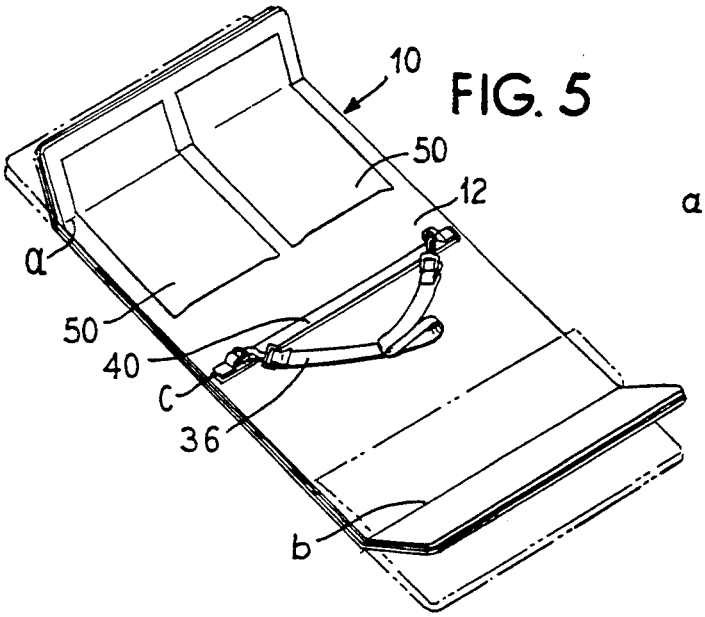
FIG. 5 illustrates a perspective view of the top side of the convertible bag of the present invention and further illustrates a first step in converting the convertible bag to a duffle-type bag.

Referring now to FIG. 5, the exterior side of the back wall 14 of the carrier 10 is first placed down, for example, on a flat surface. The exterior side of the top wall 12 may include additional compartments 50 for holding miscellaneous articles when the carrier 10 is used as a garment bag. The additional compartments 50 may be open-type compartments, i.e. without a fastening device for enclosing, such as velcro fasteners, slide fasteners or the like. In the alternative, the additional compartments 50 may be closed-type compartments by providing additional fasteners for enclosing the same.

Figure 6:
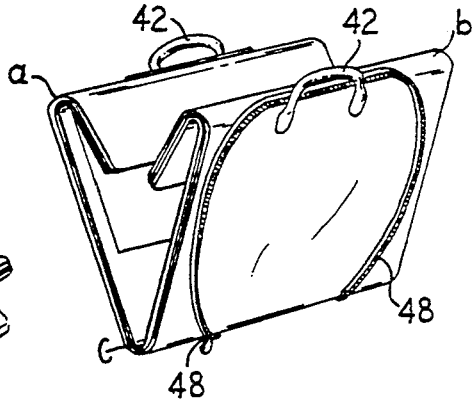
FIG. 6 illustrates a perspective view of a second step for forming a duffle-type bag from the convertible bag of the present invention.

To begin the conversion of the carrier 10 from the garment bag to the duffle-type bag, opposite ends of the carrier 10 are folded at lines generally illustrated at a, b. The fold lines a, b are substantially adjacent opposite ends of the slide fastener 48 of the formed duffle-type bag as shown in FIG. 6. After the first folds are made at the lines a, b, a third fold is made at a line c substantially defined by the reinforcing point 40 onto which the shoulder strap 36 is secured. After the fold is made at the fold line c, the slide fastener 48 is used to form the duffle-type bag.

Figure 7:
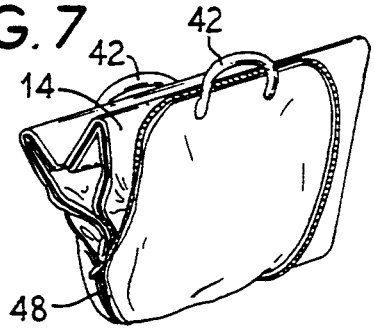
FIG. 7 illustrates a perspective view of a third step for forming the duffle-type bag from the garment bag of the convertible bag of the present invention.

With reference to FIG. 7, the duffle-type bag is formed by a user assisting in urging the remainder of the exterior side of the back wall 14 of the carrier 10 within the interior of the duffle-type bag. As the remainder of the back wall 14 is urged into the interior of the duffle-type bag, the slide fastener 48 may be continuously secured about the duffle-type bag. The slide fastener 48 may be a single fastener as shown or may be a fastener of the type which starts at both ends and meets at an intermediate point, such as beneath the handles 42, for example. In this manner, the interior of the duffle-type bag may be accessed at a point near the handles 42 or any point about the three sides enclosing the carrier 14 within the fastener 48.

The slide fastener 48 is a wide-tooth fastener and a substantially more durable fastener than the slide fastener 16 which encloses the interior 22 of the carrier 10 to form the garment bag. The slide fastener 16 is substantially smaller than the fastener 48 and is also pliable. The pliability of the fastener 16 simplifies urging of the carrier 10 into the interior of the garment bag during conversion to the duffle-type bag.

Figure 8:
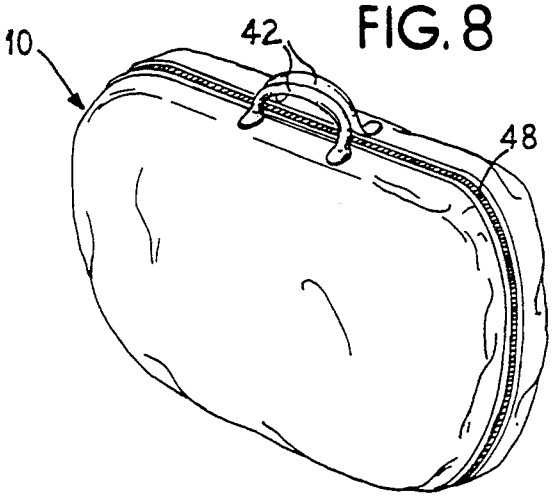
FIG. 8 illustrates a perspective view of a duffle-type bag converted from the garment bag of the convertible bag of the present invention.
Figure 9:
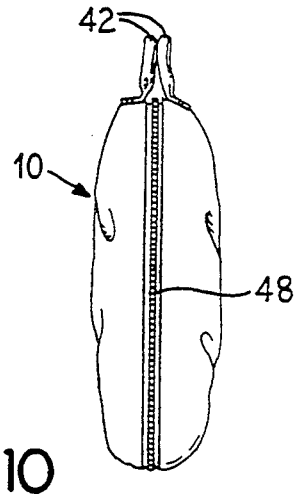
FIG. 9 illustrates a side view of the duffle-type bag of the convertible bag of the present invention.

FIG. 8 illustrates the carrier 10 in the duffle-type bag mode wherein the handles 42 are positioned for carrying by a user. In this mode, the carrier 10 is conveniently available for, for example, carrying articles such as athletic wear, tennis shoes, books, personal radios, cosmetics, and the like. As shown in FIG. 9, the carrier 10 forms an aesthetically pleasing upright bag in the duffle-type bag mode.

Figure 10:
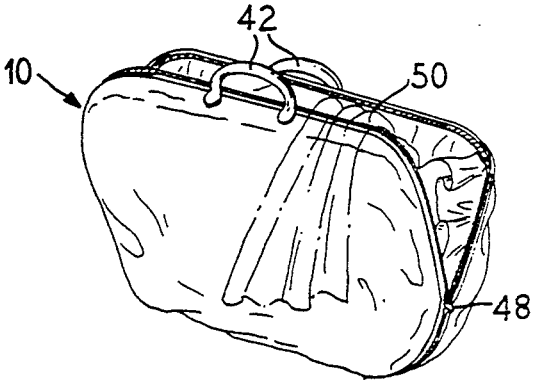
FIG. 10 illustrates a perspective view of the duffle-type bag of the present invention in a partially open state.

FIG. 10 illustrates the carrier 10 in the duffle-type bag mode partially opened with, for example, a towel 50 draped from the opening. The fastener 48 is partially opened by a user to create the opening to the carrier 10 for access to the interior of the carrier 10.

The carrier 10 may be made of a variety of materials including, but not limited to, canvas, leather, vinyl and the like. In a preferred embodiment, the material of the carrier 10 is water-proof.

Further, the dimensions of the bag may be varied as desired. However, the garment bag may be more conventionally sized for enabling carrying of suits, uniforms, or the like. The size of the duffle-type bag may be altered by varying the size of the exterior wall 46 which forms the exterior of the duffle-type bag. In addition, one or both of the handles 42 may be implemented in place of the suspending device 34. That is, one of the handles 42 may be placed over a hook on a door, wall, or the like to position the carrier 10 in a position for access to the interior 22 of the carrier 10.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim as my invention:

1. A convertible bag for holding a first set of articles of clothing in a first mode and a second set of articles of clothing in a second mode, the bag comprising:

a first compartment having an interior substantially defined by a top wall, a bottom wall, two side walls, a back wall and a front wall wherein the interior is accessed by folding the front wall along a fold in one of the top wall, the bottom wall, or two side walls and further wherein the interior includes a means for supporting at least one hanging article of the first set of articles therein in the first mode;

a first closure securing the front wall in a selectively opened or closed position wherein, in the closed position, the first set of articles is enclosed in the interior in the first mode and further wherein the first compartment is formed by securing of the first closure; and a second closure on an exterior side of one of the walls of the first compartment wherein the second closure encompasses an area defining a substantial portion of the exterior side when in an unsecured position and further wherein the second closure is spaced from a periphery of the exterior side such that the second closure, when secured, forms a second compartment holding the second set of articles in the second mode independent of the first articles in the first mode, the first compartment usable only when the second compartment is not in use.

2. The convertible bag of claim 1 further comprising:

a multi-positionable restraining bar constructed and arranged in the interior of the first compartment wherein the restraining bar, in a first position, maintains position of at least one of the articles of the first set in the first mode.

3. The convertible bag of claim 2 wherein the restraining bar, in a second position, is collapsible enabling use of the second compartment.

4. The convertible bag of claim 2 wherein the restraining bar, in a third position, is removable to enable use of the second compartment.

5. The convertible bag of claim 1 further comprising:

a strap constructed and arranged to assist in carrying the bag during use in the first mode.

6. The convertible bag of claim 1 wherein the first closure is a slide fastener having a plurality of teeth and the second closure is a slide fastener having a plurality of teeth.

7. The convertible bag of claim 1 further comprising:

at least one handle constructed and arranged to hold the bag in the second mode.

8. The convertible bag of claim 1 wherein the second closure comprises a pair of slide fasteners.

9. A bag convertible between a garment bag for carrying a first set of articles of clothing and a duffle-type bag for carrying a second set of articles of clothing, the bag comprising:

a first closure;

a front wall and a back wall substantially secured together by the first closure forming a first compartment having a first interior holding the first set of articles;

a second closure arranged on an exterior side of the back wall encompassing an area of the exterior side of the back wall in an unsecured position of the second closure wherein the area is a substantial portion of the exterior side of the back wall and smaller than an area defined by a periphery of the back wall and further wherein the area of the exterior side is divisible at a fold line dividing the area into two substantially equivalent areas; and a second compartment formed by securing the second closure forming a second interior holding the second set of articles wherein the first compartment is usable to hold the first set of articles only when the second compartment is not in use holding the second set of articles.

10. The bag of claim 9 further comprising:

at least one exterior compartment holding additional articles outside of the interior of the first compartment.

11. The bag of claim 9 further comprising:

a restraining bar securing at least a portion of the first set of articles within the first compartment.

12. The bag of claim 9 further comprising:

an interior hanging device within the interior of the first compartment.

13. The bag of claim 9 further comprising:

an exterior hanging device constructed and arranged to suspend the garment bag to assist in accessing of the interior of the first compartment.

14. The bag of claim 9 further comprising:

a strap secured to an exterior portion of the garment bag to assist in carrying of the garment bag.

15. The bag of claim 9 further comprising:

at least one handle on an exterior of the duffle bag for carrying of the duffle bag.

* * * * *